US009792866B2

(12) United States Patent
Lee et al.

(10) Patent No.: US 9,792,866 B2
(45) Date of Patent: Oct. 17, 2017

(54) DETECTING AND ELIMINATING METHOD FOR GHOSTING EFFECT OF LCD

(75) Inventors: Chao-Hua Lee, Taipei (TW); Jong-Dae Oh, Taipei (TW); Xiao-Song Zhou, Taipei (TW); C.-C. Jay Kuo, Taipei (TW)

(73) Assignee: Flextronics Computing Mauritus Ltd., Ebene (MU)

( * ) Notice: Subject to any disclaimer, the term of this patent is extended or adjusted under 35 U.S.C. 154(b) by 2843 days.

(21) Appl. No.: 11/293,456

(22) Filed: Dec. 2, 2005

(65) Prior Publication Data

US 2007/0126675 A1 Jun. 7, 2007

(51) Int. Cl.
*G09G 3/36* (2006.01)

(52) U.S. Cl.
CPC ... *G09G 3/3648* (2013.01); *G09G 2320/0252* (2013.01); *G09G 2320/0261* (2013.01); *G09G 2340/16* (2013.01)

(58) Field of Classification Search
CPC ... G06G 2320/0252; G06G 2320/0216; G06G 2340/16
USPC ..... 345/87, 55, 204
See application file for complete search history.

(56) References Cited

U.S. PATENT DOCUMENTS

| | | | | |
|---|---|---|---|---|
| 5,638,091 | A * | 6/1997 | Sarrasin | 345/692 |
| 6,119,083 | A * | 9/2000 | Hollier et al. | 704/243 |
| 7,005,675 | B2 * | 2/2006 | Sakamoto et al. | 257/59 |
| 2002/0003520 | A1 * | 1/2002 | Aoki | 345/87 |
| 2005/0213041 | A1 * | 9/2005 | Schmelzer | 352/87 |
| 2005/0253876 | A1 * | 11/2005 | Tsai et al. | 345/690 |
| 2006/0188148 | A1 * | 8/2006 | Nako et al. | 382/162 |
| 2007/0063940 | A1 * | 3/2007 | Juenger | 345/87 |
| 2007/0081344 | A1 * | 4/2007 | Cappaert et al. | 362/373 |

* cited by examiner

*Primary Examiner* — William Boddie
*Assistant Examiner* — Leonid Shapiro
(74) *Attorney, Agent, or Firm* — Haverstock & Owens LLP

(57) ABSTRACT

Methods for detecting and eliminating a ghosting effect of liquid crystal display (LCD) are disclosed. The ghosting effect detecting method comprises the steps of providing a visual persistency period, providing a maximum color alternation speed of the LCD, obtaining a threshold value by multiplying the human visual persistency period by the maximum color alternation speed, calculating a variation of an intensity level of each of the plurality of pixel components of the LCD and comparing the threshold value and the variation of the intensity level to obtain a comparison result to determine whether the ghosting effect exists in the pixel component.

9 Claims, 6 Drawing Sheets

DETECTING AND ELIMINATING METHOD FOR GHOSTING EFFECT OF LCD

FIELD OF THE INVENTION

The present invention is related to methods for detecting and eliminating ghosting effect of liquid crystal display (LCD), particularly of a thin film transistor (TFT) LCD.

BACKGROUND OF THE INVENTION

Liquid crystal display (LCD) has been widely used as a display for desktop computer, notebook computer, television and the like. With the aid of the continuously enhanced technology, the LCD is expected to have a wider range of applications and enhanced quality.

However, when compared to a traditional cathode ray tube (CRT) or plasma display, the LCD has a relatively lower response speed, i.e. a longer response time, which is due to the device structure within the LCD.

In the LCD, each pixel structure has its color filters, each used for generating a red, green or blue sub-pixel. That is, each pixel structure has red, green and blue sub-pixels. For each pixel, the response time depends on how rapidly the transistors controlling the pixel may be turned on and off again, the transistors being disposed in the LCD. In some cases, the response time is critical. For example, when a video game or movie is displayed, a too slow response speed of the LCD may adversely affect presentation of a moving object, particularly when the object moves rapidly. In this case, a trailing effect may occur at edges of the moving object, which is generally termed as ghosting effect. Therefore, to achieve a high quality LCD the ghosting effect involved in the image has to be resolved.

Although the response time, a main cause of the ghosting effect, has been greatly reduced with the use of improved hardware associated with the LCD, it is achieved at the cost of a relatively higher cost. In addition, more and more demands for large-sized LCD are arisen and equipping the large-sized LCD with a relatively shorter response time is considerably difficult in a manufacturing view, which is due to the reason that the ghosting effect of the large-sized LCD is hard to be eliminated. Unfortunately, there has hitherto not been any effective method for detecting and eliminating the ghosting effect.

In view of the drawback existing in the prior art, the Inventor of the present invention set forth methods for detecting and eliminating the ghosting effect of LCD after a series of intensive research and experiment are made.

SUMMARY OF THE INVENTION

It is, therefore, an object of the present invention to provide methods for detecting and eliminating ghosting effect of liquid crystal display (LCD), which may be directly applied to an image input terminal of the LCD or within an integrated circuit (IC) controlling the LCD.

In accordance with the present invention, the detecting and eliminating methods are performed based on digital image processing technology with an algorithm involved therein, which is simple in implementation. With the detecting and eliminating methods executed, a low cost LCD having a relatively longer response time may be enhanced in quality. Therefore, a high quality LCD may be reduced in cost with the methods of the present invention utilized.

In accordance with the present invention, the method for detecting the ghosting effect of LCD comprises the steps of providing a visual persistency period, providing a maximum color alternation speed of the LCD, obtaining a threshold value by multiplying the human visual persistency period by the maximum color alternation speed, calculating a variation of an intensity level of each of the plurality of pixel components of the LCD and comparing the threshold value and the variation of the intensity level to obtain a comparison result to determine whether the ghosting effect exists in the pixel component.

In accordance with one embodiment of the present invention, the method for eliminating the ghosting effect of liquid crystal display (LCD) having a plurality of pixel elements comprises the steps of obtaining a threshold value by multiplying a visual persistence period and a maximum color alternation speed, calculating a variation of an intensity level of each of the plurality of pixel components of the LCD and rectifying the variation of the intensity level based upon the threshold value so as to make the threshold value greater than the variation of the intensity level.

In accordance with another embodiment of the present invention, the method for eliminating a ghosting effect of a liquid crystal display (LCD) having a plurality of pixel components comprises the steps of providing a visual persistency period, determining a maximum color alternation speed by providing a first frame having a first intensity level on the LCD at a first point of time and providing a second frame having a second intensity level on the LCD at a second point of time, providing a third frame having a third intensity level on the LCD at at least a third point of time between the first and second points of time to obtaining a slope defined as a simulated color alternation speed of the LCD by calculating a ratio of a variation between the third and first intensity levels and a variation between the third and first points of time, obtaining a threshold value by multiplying the visual persistency period with the maximum color alternation speed, calculating a variation of an intensity level of each of the plurality of pixel components of the LCD, and rectifying the variation of the intensity level based upon the threshold value so that the threshold value is greater than the variation of the intensity level.

Other objects, advantages and efficacies of the present invention will be described in detail below taken from the preferred embodiments with reference to the accompanying drawings.

BRIEF DESCRIPTION OF THE DRAWINGS

The foregoing summary, as well as the following detailed description of the preferred embodiment, is better understood when read in conjunction with the appended drawings. It is understood, however, that the invention is not limited to the specific methods and disclosed or illustrated. In the drawings.

DETAILED DESCRIPTION OF THE PREFERRED EMBODIMENT

The present invention discloses methods for detecting and eliminating a ghosting effect of liquid crystal display (LCD), particularly of thin film transistor (TFT) LCD. The detecting method will be first explained as follows.

The ghosting effect includes two types of effects: trailing effect and blinking effect, which are both caused on a rapidly moving object on the LCD due to transistors within the pixels of the LCD. To alleviate the ghosting effect, any pixel of the LCD having it is required to be first detected and recognized. In the following, essentials of cause of the trailing and blinking effects will be respectively discussed and through which the methods for detecting and recognizing the pixel having the ghosting effect caused may be achieved.

Figure 1:
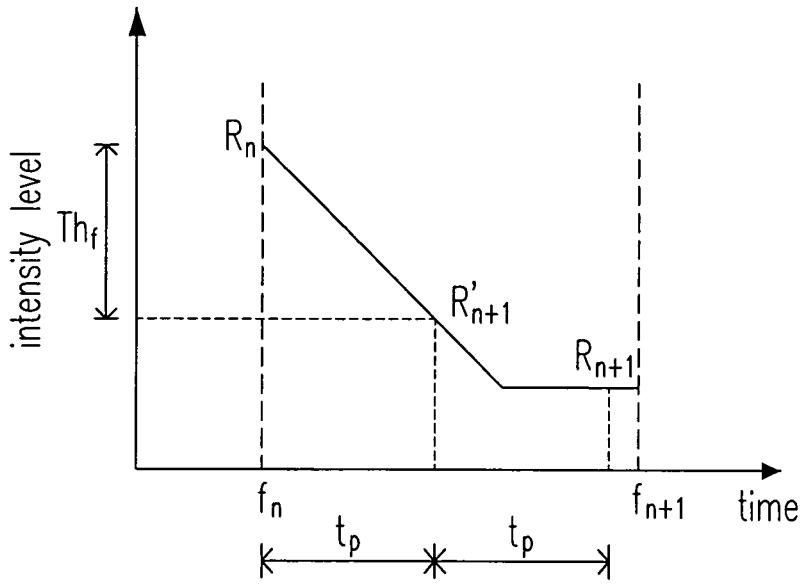
FIG. 1 is a schematic diagram illustrating a method of detecting a ghosting effect according to the present invention.

FIG. 1 is a schematic diagram illustrating the method for detecting the ghosting effect according to the present invention. In the figure, the horizontal axis represents time while the longitudinal axis represents intensity level of a pixel component.

As shown, the intensity level of a red component of a pixel is changed from a first frame $R_n$ to a second frame $R_{n+1}$. In the LCD, the former intensity level may generally successfully transitions to the latter intensity level (for a 30 picosecond (ps) image, a typical frame rate is 33 millisecond (ms)). If human eyes have a visual sensitivity more than the frame rate, a color alternation of the pixel may be easier to be sensed.

As shown in FIG. 1, $t_p$ represents a human visual persistency period, which is a visual processing time for human or a time an image may maintain on the human retina and typically less than 20 ms. As a result, human can sense color of a specific point before the next frame displays. As shown, if a user's visual sensitivity can not catch up with the frame rate with respect to the point having the color, he/she can not sense the desired color $R_{n+1}$ but a different color $R'_{n+1}$. Only after another $t_p$, he/she can sense the desired color $R_{n+1}$. As such, the sensitivity of the different colors introduces a trailing effect behind a moving object on the LCD. In addition, a blinking effect can also be resulted in at edges of an object having an irregular shape, such as a moving book.

Based on the understanding of the cause of the ghosting effect, the method for detecting the ghosting effect of the invention is set forth.

In FIG. 1, a threshold value $Th_f$ represents a maximum color alternation amount achieved by the LCD within the human visual persistency period $t_p$. If a pixel component of a given pixel has a variation of the intensity level greater than the threshold value $Th_f$, the LCD can not reach the desired level within the human visual persistency period. In this case, the ghosting effect occurs on the pixel. By means of this principle, the pixel having the ghosting effect may be recognized.

Prior to performance of the detecting method with respect to the ghosting effect, the threshold value $Th_f$ has to be obtained, which is calculated as:

$$Th_f = t_p \times V_{LCDf},$$

wherein $t_p$ is approximately the human visual persistency period and $V_{LCDf}$ is a falling speed of color alternation of the LCD.

The human visual persistency period varies from one person to another, which can only be estimated and may be used to simulate performance of a cathode ray tube (CRT). For example, if a refreshing rate of 85 Hz is used to simulate performance of the LCD, then $t_p$ is 12 ms.

The color alternation speed is dependent on the response time, which is determined by manufacture of the LCD. A LCD of relatively lower response time results in a more rapid color alternation speed. Generally, the color alternation speed is different for rising and falling of the intensity level, thus thresholds for the intensity level rising and falling pixel components are required to be calculated respectively.

The method for detecting the ghosting effect may be applied real time to the image display frame, and may have the following presentation.

```
//Loop through each pixel
IF pixel.red.next > pixel.red     //rising
IF pixel, red next – pixel, red > THRESHOLD. RED.RISING
    Ghosting effect caused by red components, ghosting effect removal
    process needed
END
ELSE                              //falling
1F pixel.red – pixel.red.uext > THRESHOLD.RED.FALLING
    Ghosting effect caused by red components, ghosting effect removal
    process used
END
END //red component
IF pixel.greeu.next > pixel.green     // rising
    IF pixel.green, uext – pixel.green > THRESHOLD. GREEN.RISING
    Ghosting effect caused by green components, ghosting effect removal
    process needed
    END
ELSE                              //falling
    IF pixel.green – pixel.green.next > THRESHOLD.
    GREEN.FALLING
    Ghosting effect caused by green components, ghosting effect removal
    process needed
    END
END //green component
IF pixel.blue.uext > pixel.blue     //rising
    IF pixel.blue.next – pixel.blue > THRESHOLD.BLUE.RISING
    Ghosting effect caused by blue components, ghosting effect removal
    process needed
    END
ELSE                              //falling
    IF pixel.blue – pixel.blue.next > THRESHOLD.BLUE.FALLING
    Ghosting effect caused by blue components, ghosting effect removal
    process needed
    END
END @@blue component
```

Now, the following description will be made to the method for eliminating the ghosting effect of LCD of the invention. There is two ghosting effect eliminating methods, each having a respective algorithm, set forth in the invention, which are assigned herein as first and second embodiments, respectively.

In the first embodiment, the algorithm is provided to exempt from sensation of two different colors between two consecutive frames, so as to eliminate the ghosting effect.

Since the threshold value means the maximum color alternation amount achievable by the LCD within the human visual persistency period, only the intensity level of the pixel component is required to be rectified in quest of the changing amount thereof less than the threshold value. By doing this, the LCD may reach the rectified intensity level within the human visual persistency period and the intensity level does not further change during the time the current frame transition to the next frame. As a result, only a single color may be sensed when the current frame transitions.

Figure 2:
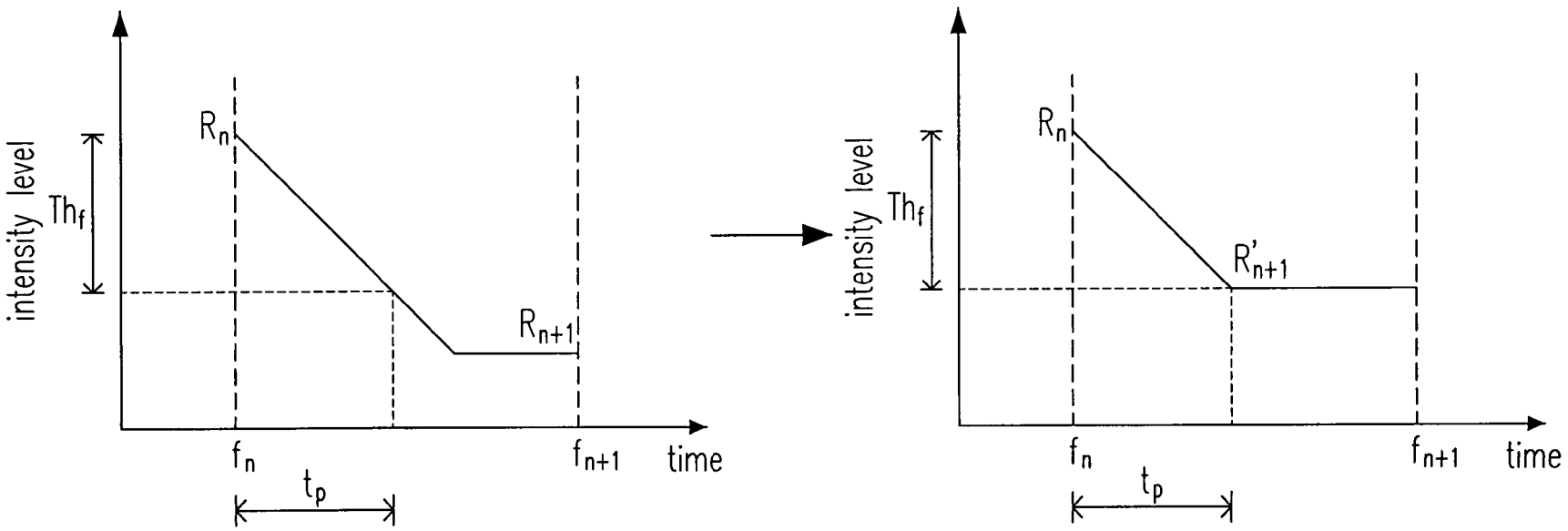
FIG. 2 is a schematic diagram illustrating a method of eliminating the ghosting effect according to a first embodiment of the present invention.

FIG. 2 is a schematic diagram illustrating the method for eliminating the ghosting effect of LCD according to a first embodiment of the present invention. In the figure, the intensity level of the red component of the pixel is changed into $R'_{n+1}$ so that the LCD can reach the desired intensity level within the human visual persistency period. The eliminating method corresponds to an algorithm, which may be combined with the algorithm associated with the ghosting effect detecting method described above as follows.

```
/] Loop through each pixel
{
    IF pixeI.red.next > pixel.red     //rising
    IF pixel.red next − pixel.red > THRESHOLD.RED.RISING
    pixel.red.next = pixel.red + THRESHOLD.RED.RISING;
END
ELSE                              //falling
    IF pixel.red − pixel.red.next > THRESHOLD.RED.FALLING
    pixel.red.next = pixel.red − THRESHOLD.RED.FALLING;
    END
END //red component
IF pixel.green.next > pixel.green     // rising
    IF pixeI.green.next − pixel.green.next > THRESHOLD.
    GREEN.RISING
    pixel.green, next = pixel.green + THRESHOLD.
    GREEN.RISING;
    END
ELSE                              //falling
    IF pixel.green.next − pixel.green.next > THRESHOLD.
    GREEN.FAILING
    pixel.green.next = pixeI.green − THRESHOLD.GREEN.FALLING;
    END
END //green component
IF pixel.blue.next > pixel.blue        //rising
        1F pixel.blue.next− pixel.bIue > THRESHOLD.BLUE.RISING
    , pixel.blue.next = pixel.blue + THRESHOLD.BLUE.RISING;
    END
ELSE                                   //falling
    IF pixel.blue − pixel.bluea.next > THRESHOLD.BLUE.FALLING
    pixel.blue.next = pixel.blue − THRESHOLD.BLUE.FALLING;
    END
END //blue component
```

After some experiments, it is demonstrated that the above ghosting effect eliminating method embodiment can effectuate elimination of the ghosting effect, particularly the blinking effect.

Now, description will be made to the second embodiment of the method for eliminating the ghosting effect of LCD according to the present invention. The second embodiment is set forth due to that color alternation may still be observed when the current frame transitions in the first embodiment. This is due to the fact that colors of those pixel components having the ghosting effect introduced during the transition time can not be altered into the desired levels. Therefore, the second embodiment is set forth to improve the disadvantage existing in the first embodiment.

Assuming a frame signal for the LCD can be changed more rapidly, the pixel components having the ghosting effect introduced may each be forced to have one or more times of update during the transition time.

Figure 3:
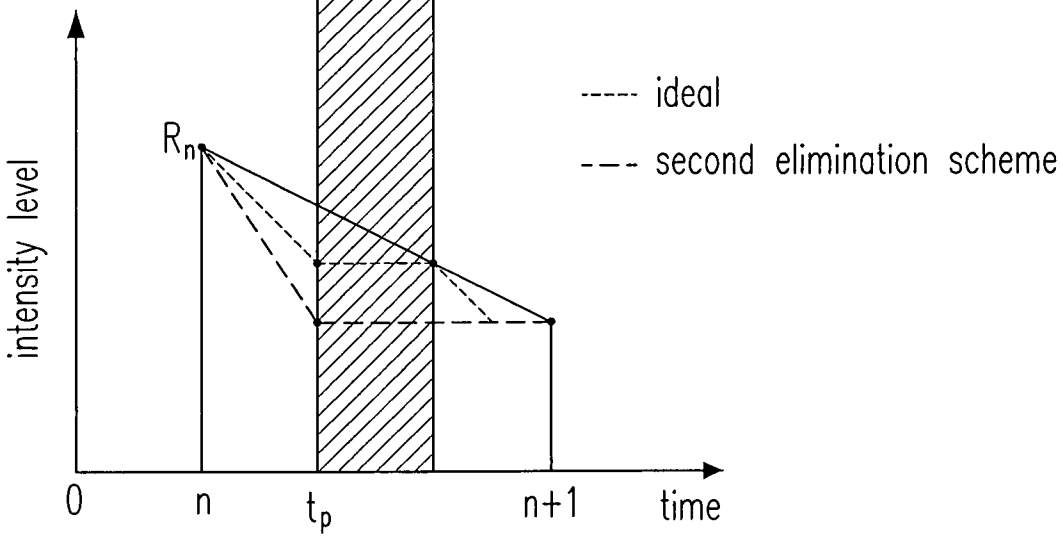
FIG. 3 is a schematic diagram illustrating the method of eliminating the ghosting effect according to a second embodiment of the present invention.

FIG. 3 is a schematic diagram illustrating the method for eliminating the ghosting effect according to the second embodiment of the present invention. As shown, an algorithm corresponding to the second ghosting effect eliminating method embodiment may be simulated by adding one or more frames between the two consecutive frames (those at points of time n and n+1). For the added frames, the intensity level of each frame is set according to the first ghosting effect eliminating method embodiment so that the LCD may reach the desired color within a visual persistency period, which is generally a human visual persistency period. That is, the intensity level of the pixel components with ghosting effect transitions gradually from that at the first point of time n to the second point of time n+1 through at least one point of time so that the desired color can be achieved before the time period between the two consecutive frames ends. In FIG. 3, the cases where one and more frames are additionally introduced between the original consecutive frames are shown.

Figure 4A:
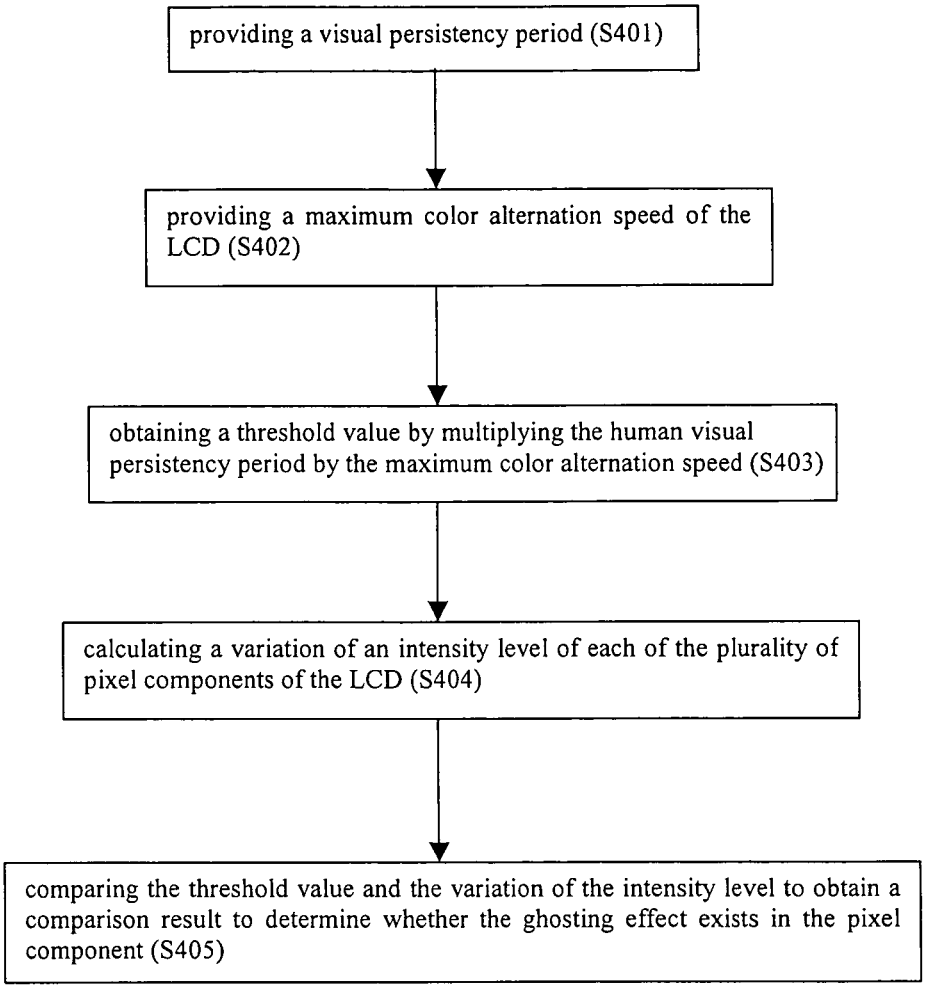
FIG. 4 is a schematic diagram illustrating the methods of detecting and eliminating the ghosting effect according to the present invention.
Figure 4B:
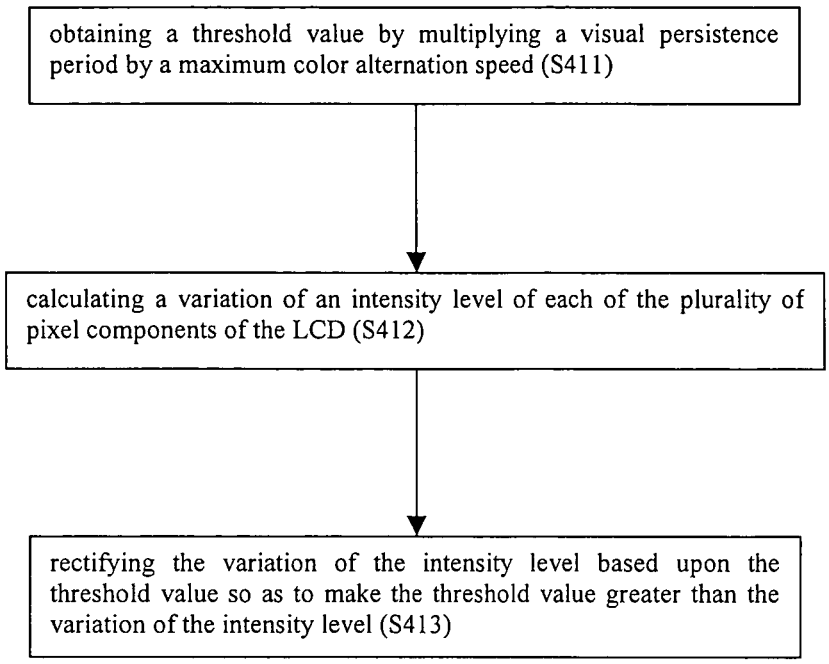
Figure 4C:
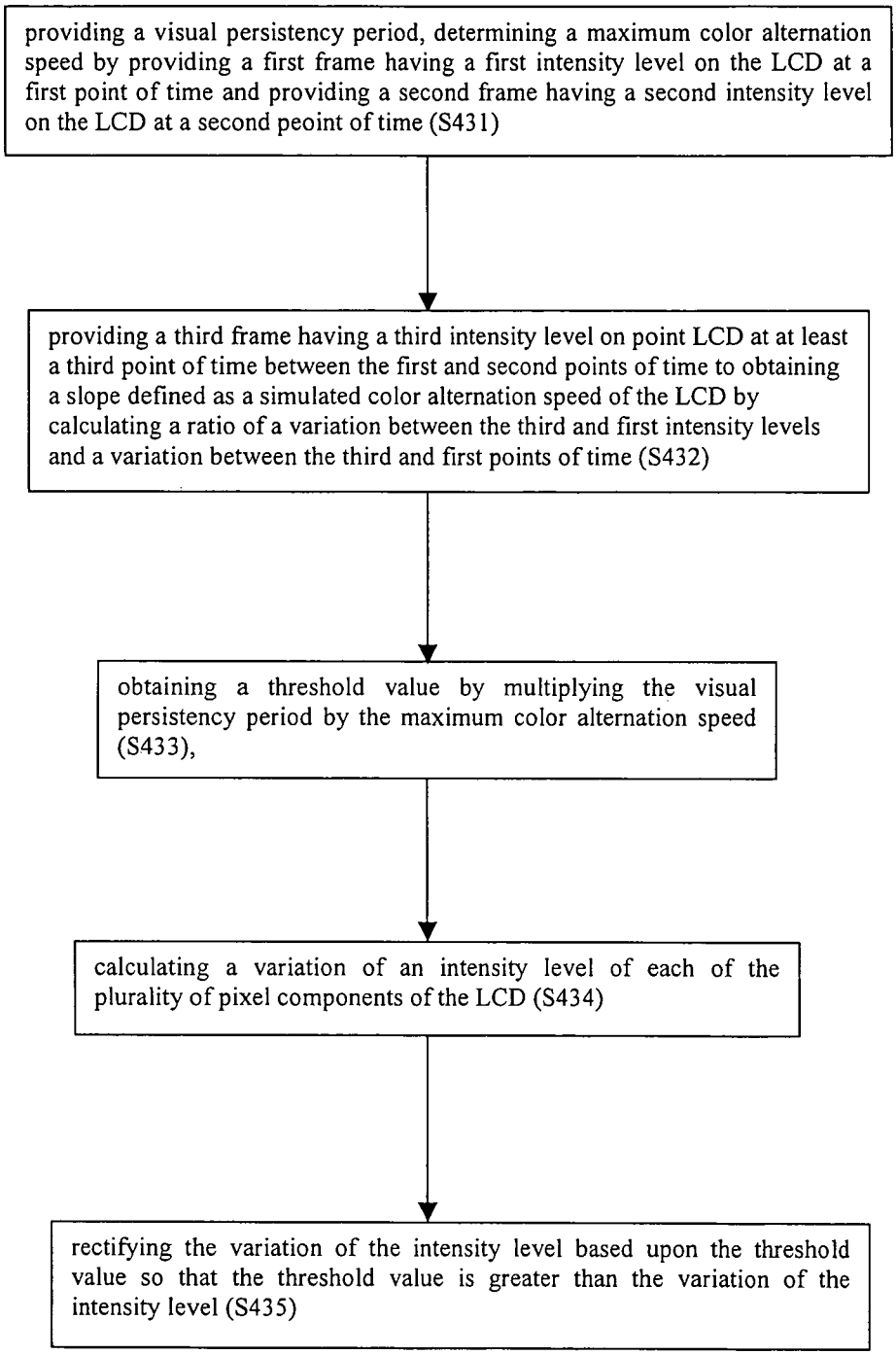

To summarize the methods of detecting and eliminating the ghosting effect of LCD of the invention, flowcharts thereof are provided in FIG. 4(*a*)-4(*c*). As shown, the method for detecting the ghosting effect of LCD comprises the steps of providing a visual persistency period (S401), providing a maximum color alternation speed of the LCD (S402), obtaining a threshold value by multiplying the human visual persistency period by the maximum color alternation speed (S403), calculating a variation of an intensity level of each of the plurality of pixel components of the LCD (S404), and comparing the threshold value and the variation of the intensity level to obtain a comparison result to determine whether the ghosting effect exists in the pixel component (S405). The method for eliminating the ghosting effect of liquid crystal display (LCD) having a plurality of pixel elements comprises the steps of obtaining a threshold value by multiplying a visual persistence period and a maximum color alternation speed (S411), calculating a variation of an intensity level of each of the plurality of pixel components of the LCD (S412) and rectifying the variation of the intensity level based upon the threshold value so as to make the threshold value greater than the variation of the intensity level (S413). The method for eliminating a ghosting effect of a liquid crystal display (LCD) having a plurality of pixel components comprises the steps of providing a visual persistency period, determining a maximum color alternation speed by providing a first frame having a first intensity level on the LCD at a first point of time and providing a second frame having a second intensity level on the LCD at a second point of time (S431), providing a third frame having a third intensity level on the LCD at at least a third point of time between the first and second points of time to obtaining a slope defined as a simulated color alternation speed of the LCD by calculating a ratio of a variation between the third and first intensity levels and a variation between the third and first points of time (S432), obtaining a threshold value by multiplying the visual persistency period with the maximum color alternation speed (S433), calculating a variation of an intensity level of each of the plurality of pixel components of the LCD (S434), and rectifying the variation of the intensity level based upon the threshold value so that the threshold value is greater than the variation of the intensity level (S435).

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A method for eliminating a ghosting effect of a liquid crystal display (LCD) device having a plurality of pixel elements, comprising:

(a) calculating a threshold value for the maximum permissible change in the intensity value of a pixel element of the plurality of pixel elements from one frame of displayed video to a next frame of displayed video by multiplying a visual persistence period and a maximum color alternation speed of the LCD device;

(b) for each pixel of the plurality of pixel elements, calculating a variation of an intensity level from one frame of input video data to a next frame of the input video data;

(c) for each pixel of the plurality of pixel elements, if the variation of the intensity level of the pixel is greater than the threshold value, changing the intensity level of the pixel based upon the threshold value so as to make the variation of the intensity level of the pixel no greater than the threshold value; and (d) for each pixel of the plurality of pixel elements, if the variation of the intensity level of the pixel is greater than the threshold value, displaying the changed intensity level of the pixel rather than the intensity level of the pixel element from the input video data;

wherein changing the variation of the intensity level in this manner minimizes the ghosting effect that is visible to a human viewing the LCD device.

2. The method according to claim 1, wherein the ghosting effect comprises a trailing effect and a blinking effect.

3. The method according to claim 1, wherein the visual persistence period is a human visual persistence period and greater than 0 and less than 20 milliseconds.

4. The method according to claim 1, wherein the step (b) further comprises the steps of:

providing a first frame having a first intensity level on the LCD device at a first point of time;

providing a second frame having a second intensity level on the LCD device at a second point of time; and finding a slope defined as the maximum color alternation speed by calculating a ratio of a variation between the first and second intensity levels and a variation between the first and second points of time.

5. The method according to claim 1, further comprising:

providing a visual persistency period;

determining a maximum color alternation speed by providing a first frame having a first intensity level on the LCD device at a first point of time and providing a second frame having a second intensity level on the LCD device at a second point of time;

providing a third frame having a third intensity level on the LCD device at least a third point of time between the first and second points of time to obtaining a slope defined as a simulated color alternation speed of the LCD device by calculating a ratio of a variation between the third and first intensity levels and a variation between the third and first points of time.

6. The method according to claim 5, wherein the ghosting effect comprises a trailing effect and a blinking effect.

7. The method according to claim 5, wherein the visual persistence period is a human visual persistence period and greater than 0 and less than 20 milliseconds.

8. The method according to claim 1, further comprising repeating steps (b) through (d) as a cycle for each of a set of remaining frames of the displayed video, wherein the next frame of each cycle becomes the one frame of the subsequent cycle.

9. The method according to claim 1, wherein the calculating of the variation of the intensity level from the one frame of input video data to the next frame of the input video data comprises:

determining a first intensity of the pixel in the one frame;

determining a second intensity of the pixel in the next frame; and calculating the variation by determining the difference between the first intensity and the second intensity of the pixel.

* * * * *